US008394289B2

(12) United States Patent
Satou et al.

(10) Patent No.: US 8,394,289 B2
(45) Date of Patent: Mar. 12, 2013

(54) COMPOSITION FOR ETCHING TREATMENT OF RESIN MOLDED ARTICLE

(75) Inventors: Kazuya Satou, Osaka (JP); Yusuke Yoshikane, Osaka (JP)

(73) Assignee: Okuno Chemicals Industries Co., Ltd., Osaka-shi (JP)

( * ) Notice: Subject to any disclaimer, the term of this patent is extended or adjusted under 35 U.S.C. 154(b) by 964 days.

(21) Appl. No.: 12/297,371

(22) PCT Filed: Mar. 2, 2007

(86) PCT No.: PCT/JP2007/054032

§ 371 (c)(1), (2), (4) Date: Oct. 16, 2008

(87) PCT Pub. No.: WO2007/122869

PCT Pub. Date: Nov. 1, 2007

(65) Prior Publication Data

US 2009/0092757 A1 Apr. 9, 2009

(30) Foreign Application Priority Data

Apr. 18, 2006 (JP) ..... 2006-114229

(51) Int. Cl.
*C09K 13/00* (2006.01)
*C23C 30/00* (2006.01)
*C23F 1/00* (2006.01)

(52) U.S. Cl. ..... 252/79.1; 252/79.2; 216/13; 216/83; 216/96; 427/98; 427/256

(58) Field of Classification Search ..... 252/79.1, 252/79.2; 216/13, 83, 96
See application file for complete search history.

(56) References Cited

U.S. PATENT DOCUMENTS 4,820,548 A 4/1989 Courduvelis et al.
5,143,592 A * 9/1992 Toro ..... 205/210
5,358,602 A * 10/1994 Sutcliffe et al. ..... 216/13
2004/0013825 A1 1/2004 Chen
2004/0096584 A1* 5/2004 Naruskevicius et al. ..... 427/306
2004/0118690 A1 6/2004 Yoshitani
2004/0237295 A1* 12/2004 Wakizaka et al. ..... 29/830
2005/0139811 A1* 6/2005 Aisenbrey ..... 252/512
2005/0214449 A1* 9/2005 Hirst et al. ..... 427/98.7

FOREIGN PATENT DOCUMENTS

JP 50-89476 A 7/1975
JP 54-117328 * 9/1979
JP 54-117328 A 9/1979
JP 2002-53973 A 2/2002
JP 2002-530529 A 9/2002
JP 2002-363761 A 12/2002
JP 2003-41375 A 2/2003
JP 2003-193247 A 7/2003
JP 2004-190104 A 7/2004
WO 00/29646 A1 5/2000
WO 2004/009369 A1 1/2004

OTHER PUBLICATIONS

International Search Report of PCT/JP2007/054032, date of mailing Jun. 5, 2007.
Supplementary European Search Report dated Jul. 8, 2010, issued in corresponding European Patent Application No. 07737680.4.
Japanese Office Action date May 26, 2010, issued in corresponding Japanese Patent Application No. 2008-511994.

* cited by examiner

*Primary Examiner* — Shamim Ahmed
(74) *Attorney, Agent, or Firm* — Westerman, Hattori, Daniels & Adrian, LLP

(57) ABSTRACT

A composition for the etching treatment of a resin molded article. The composition is composed of an aqueous solution containing 20 to 1,200 g/l of an inorganic acid, 0.01 to 10 g/l of a manganese salt, and 1 to 200 g/l of at least one component selected from the group consisting of halogen oxoacids, halogen oxoacid salts, persulfate salts, and bismuthate salts. The etching composition of the invention is an etching solution capable of forming a plating film having a good adhesion to various resin molded articles made of ABS resins or the like, and can be used in place of chromic acid mixtures. The composition is highly safe so that the liquid waste is easily disposed of.

4 Claims, No Drawings

COMPOSITION FOR ETCHING TREATMENT OF RESIN MOLDED ARTICLE

TECHNICAL FIELD

The present invention relates to a composition for the etching treatment of a resin molded article, an etching process using the composition, and an electroless plating process.

BACKGROUND ART

Resin molded articles have been used as automobile components in recent years to reduce the weight of automobiles. Resins such as ABS resins, PC/ABS resins, PPE resins, and polyamide resins have been used to achieve this object, and such resin molded articles are often plated with copper, nickel, or the like to provide high quality impressions and beautiful appearance.

A common method for electroplating a resin molded article comprises degreasing and etching the molded article, optionally followed by neutralization and predipping, and then applying an electroless plating catalyst using a colloidal solution containing a tin compound and a palladium compound, optionally followed by activation (treatment with an accelerator), to perform electroless plating and electroplating sequentially.

In this case, for example, when an ABS resin is a substrate to be treated, a chromic acid mixture containing a mixed solution of chromium trioxide and sulfuric acid has been widely used as an etching solution. However, chromic acid mixtures, which contain toxic hexavalent chromium, adversely affect work environments. Moreover, safe disposal of the liquid waste requires reduction of the hexavalent chromium to a trivalent chromium ion, followed by neutralization and precipitation, thus requiring complicated treatment for the disposal of the liquid waste. Therefore, in consideration of workplace safety and adverse effects of the liquid waste on the environment, avoiding the use of chromic acid-containing etching solutions is preferable. However, highly safe etching solutions usable in place of chromic acid mixtures and capable of forming a plating film with a sufficient adhesion to various resin molded articles made of ABS resins or the like have yet to be developed.

DISCLOSURE OF THE INVENTION

Problem to be Solved by the Invention

The present invention has been made in view of the state of the prior art. A primary object of the invention is to provide a novel etching solution capable of forming a plating film with good adhesion to Various resin molded articles made of ABS resins or the like, the solution being usable in place of chromic acid mixtures and highly safe so that its liquid waste can be easily disposed of.

Means for Solving the Problem

The present inventors have carried out extensive research to achieve the above object. As a result, the inventors found that when various resin molded articles made of ABS resins or the like, which have heretofore been etched using a chromic acid mixture, are plated by a process comprising etching the resin molded articles using a composition comprising an aqueous solution containing an inorganic acid, a manganese salt, and at least one component selected from the group consisting of halogen oxoacids, halogen oxoacid salts, persulfate salts, and bismuthate salts in a specific proportion, an electroless plating film having an excellent adhesion can be formed without etching treatment using an acidic solution containing hexavalent chromium. The present invention has been accomplished based on this finding.

More specifically, the present invention provides the following composition for the etching treatment of a resin molded article, an etching process using the composition, and an electroless plating process.

1. A composition for the etching treatment of a resin molded article, the composition comprising an aqueous solution containing:
20 to 1,200 g/l of an inorganic acid;
0.01 to 10 g/l of a manganese salt; and
1 to 200 g/l of at least one component selected from the group consisting of halogen oxoacids, halogen oxoacid salts, persulfate salts, and bismuthate salts.
2. A composition for the etching treatment of a resin molded article, the composition comprising an aqueous solution containing:
20 to 1,200 g/l of at least one inorganic acid selected from the group consisting of sulfuric acid and hydrochloric acid;
0.01 to 10 g/l of at least one permanganate salt; and
1 to 200 g/l of at least one component selected from the group consisting of perchloric acid, perbromic acid, periodic acid, perchlorate salts, perbromate salts, periodate salts, persulfate salts, and bismuthate salts.
3. An etching process comprising bringing a resin molded article to be treated into contact with the composition of item 1 or 2.
4. An electroless plating process comprising etching a resin molded article by the process of item 3, then applying an electroless plating catalyst, and subsequently performing electroless plating.

The etching composition, etching process, and electroless plating process of the invention are described below in more detail.

Etching Composition

The etching composition of the invention comprises an aqueous solution containing about 20 to about 1,200 g/l of an inorganic acid, about 0.01 to about 10 g/l of a manganese salt, and about 1 to about 200 g/l of at least one component selected from the group consisting of halogen oxoacids, halogen oxoacid salts, persulfate salts, and bismuthate salts. An excellent electroless plating film with a high adhesion can be formed on a resin molded article by a process comprising etching the resin molded article using the etching composition of the invention, then applying an electroless plating catalyst, and subsequently performing electroless plating.

Among the active ingredients of the etching composition of the invention, examples of inorganic acids include sulfuric acid, hydrochloric acid, nitric acid, phosphoric acid, boric acid, carbonic acid, sulfurous acid, nitrous acid, phosphorous acid, borous acid, hydrogen peroxide, perchloric acid, and the like. Sulfuric acid and hydrochloric acid are particularly preferable. Such inorganic acids can be used singly or in a combination of two or more.

The etching composition of the invention should contain an inorganic acid in an amount of about 20 to about 1,200 g/l, and preferably about 300 to about 1,000 g/l.

Among the active ingredients of the etching composition of the invention, examples of manganese salts that can be particularly preferably used are permanganate salts. Permanganate salts are not particularly limited, as long as they are water-soluble salts. Examples of permanganate salts include sodium permanganate, potassium permanganate, and the like. Such manganese salts can be used singly or in a combination of two or more.

The etching composition of the invention should contain manganese salt(s) in an amount of about 0.01 to about 10 g/l, and preferably about 0.1 to about 2.0 g/l.

Among the active ingredients of the etching composition of the invention, examples of halogen oxoacids include hypohalous acid, halous acid, halogen acid, perhalogen acid, and the like. Examples of halogens include chlorine, bromine, iodine, and the like. Examples of halogen oxoacid salts include water-soluble salts of the above-mentioned halogen oxoacids, such as sodium salts of halogen oxoacids, and potassium salts of halogen oxoacids. Examples of persulfate salts include water-soluble persulfate salts such as sodium persulfate, potassium persulfate, and ammonium persulfate. Examples of bismuthate salts include water-soluble bismuthate salts such as sodium bismuthate and potassium bismuthate.

In the present invention, the above-mentioned halogen oxoacids, halogen oxoacid salts, persulfate salts, and bismuthate salts can be used singly or in a combination of two or more. Particularly, at least one component selected from the group consisting of perhalogen acids such as perchloric acid, perbromic acid, and periodic acid, salts of these perhalogen acids, persulfate salts, and bismuthate salts is preferably used.

The etching composition of the invention should contain at least one component selected from the group consisting of halogen oxoacids, halogen oxoacid salts, persulfate salts, and bismuthate salts in an amount of about 1 to about 200 g/l, and preferably about 10 to about 100 g/l.

Specific examples of preferable etching compositions of the inventions include compositions comprising aqueous solutions containing: at least one inorganic acid selected from the group consisting of sulfuric acid and hydrochloric acid; at least one manganese salt selected from the permanganate salts; and at least one component selected from the group consisting of perchloric acid, perbromic acid, periodic acid, perchlorate salts, perbromate salts, periodate salts, persulfate salts, and bismuthate salts.

Etching Process

For the etching treatment using the etching composition of the invention, the surface of the resin molded article to be treated is brought into contact with the composition of the invention. The method therefor is not particularly limited. Any method that brings the surface of the article into sufficient contact with the composition of the invention can be used. For example, a method of spraying the composition of the invention over the article to be treated may be used. In general, efficient treatment can be achieved by immersion of the article into the composition of the invention.

There is no specific limitation on the shape, size, etc. of the resin molded article to be treated. A good plating film with excellent appearance and physical properties can be formed even on a large article having a large surface area. Examples of such large resin products include automobile parts and accessories such as radiator grills, hubcaps, medium or small emblems, and door handles; exterior equipment used in the electrical or electronic field; faucet fittings used in places where water is supplied; game machine-related products such as pachinko components; and the like.

There is no specific limitation on the kind of resin material. A particularly good electroless plating film can be formed on various resin materials that have heretofore been etched using a chromic acid-sulfuric acid mixture. More specifically, a good electroless plating film can be formed on styrene-containing resins such as acrylonitrile-butadiene-styrene copolymer resins (ABS resins); resins (AAS resins) having an acrylic rubber component in place of the butadiene rubber component of ABS resin; resins (AES resins) having an ethylene-propylene rubber component in place of the butadiene rubber component of ABS resin; and the like. Examples of resins preferably used also include alloy resins of styrene-containing resins as mentioned above and polycarbonate (PC) resins (for example, alloy resins containing a PC resin in a proportion of about 30 to about 70 wt. %). It is also possible to use polyphenylene ether resins, polyphenylene oxide resins, and like resins that have excellent heat resistance and physical properties.

The conditions for etching using the etching composition of the invention are not particularly limited. The etching conditions can be suitably selected according to the desired degree of etching. For example, when etching is performed by immersing the article to be treated into the etching composition, the temperature of the etching composition may be about 30° C. to about 70° C., and the immersion time may be about 3 to about 20 minutes.

When the surface of the resin molded article is extremely dirty, the surface may be degreased according to a usual method, prior to etching.

After the etching treatment is performed, a post-treatment is optionally performed using an agent having reducing activity to remove manganese from the surface. The agent having reducing activity is not particularly limited, and any water-soluble compound having reducing activity can be used. Examples of such compounds include saccharides such as glucose, mannitol, sucrose, and fructose; sodium hypophosphite, boron hydride, formic acid, tartaric acid, citric acid, glyoxylic acid, sulfurous acid, thiosulfuric acid, ascorbic acid, and salts thereof; dimethylamine borane, formalin, tin chloride, tin sulfate, iron chloride, iron sulfate, hydrogen peroxide, hydrazine, hydroxyamine sulfate, hydroxylamine hydrochloride, and the like. Such compounds can be used singly or in a combination of two or more.

In general, the concentration of the compound having reducing activity is usually about 0.5 to about 100 g/l. The post-treatment may be performed, for example, by immersion in a solution of the compound of about 15° C. to about 50° C. for about 1 to about 10 minutes. The appearance of the resulting plating film is thereby improved.

Plating Process

After the etching treatment is performed by the above-mentioned process, an electroless plating catalyst is applied according to a usual method to perform electroless plating.

(1) Catalyst Application Process

The process of applying an electroless plating catalyst is not particularly limited. An electroless plating catalyst such as palladium, silver, ruthenium, or the like may be applied according to a known method. For example, representative processes of applying a palladium catalyst include the so-called sensitizing-activating method, catalyzing method, and the like.

Among these methods, the sensitizing-activating method comprises sensitizing a substrate using an aqueous solution containing stannous chloride and hydrochloric acid, and then activating its surface using a solution containing a palladium salt such as palladium chloride. The catalyzing method comprises catalyzing a substrate with a mixed colloidal solution containing palladium chloride and stannous chloride, and then activating its surface using an aqueous sulfuric acid solution, an aqueous hydrochloric acid solution, or the like. Specific processing methods and processing conditions thereof may be according to known methods.

(2) Plating Method

The electroless plating solution may be any known autocatalytic electroless plating solution. Examples of such electroless plating solutions include electroless nickel plating solutions, electroless copper plating solutions, electroless cobalt plating solutions, electroless nickel-cobalt alloy plating solutions, electroless gold plating solutions, and the like.

The electroless plating conditions may be according to known methods. If necessary, two or more layers of electroless plating film may be formed.

After the electroless plating, electroplating may be performed. In this case, after the electroless plating, the surface of the plating film may be optionally activated using an aqueous solution of an acid, alkali, or the like, and then electroplating may be performed. The kind of electroplating solution is not particularly limited. The electroplating solution can be suitably selected from known electroplating solutions according to the purpose.

A plating film with a high adhesion can be formed on a resin molded article by the above method.

Effect of the Invention

When etching is performed using the etching composition of the invention, the following remarkable effects can be achieved.

(1) A plating film with a high adhesion can be formed by etching using the comparatively highly safe etching composition, without the necessity of using a highly hazardous etching solution, such as a chromic acid-containing solution.

(2) Because a highly hazardous etching solution such as a chromic acid-containing solution is not used, work environments are improved and the liquid waste can be easily disposed of with little environmental impact.

BEST MODE FOR CARRYING OUT THE INVENTION

The Examples below describe the present invention in more detail.

Examples 1 to 10 and Comparative Examples 1 to 9

Flat plates (10 cm×5 cm×0.3 cm, surface area: about 1 $dm^2$) made of an ABS resin (trade name: "CYCOLAC 3001M"; product of UMG ABS, Ltd.) were used as substrates.

The substrates were first immersed in an alkaline degreasing solution (an "ACE CLEAN A-220" bath; product of Okuno Chemical Industries Co., Ltd.) at 40° C. for 5 minutes, and washed with water.

Subsequently, the substrates were immersed into etching compositions comprising aqueous solutions containing the compounds in the amounts shown below in Table 1. The immersion temperature and time are as shown in Table 1.

The substrates were immersed into a post-treatment solution (an "OPC-1300 NEUTRALIZER" bath; product of Okuno Chemical Industries Co., Ltd.) having reducing activity at 45° C. for 3 minutes, and washed with water to remove manganese salt from the surface.

Subsequently, the substrates were immersed into a colloidal palladium-tin catalyst solution (a "CRP CATALYST" bath; product of Okuno Chemical Industries Co., Ltd.) at 30° C. for 3 minutes, and washed with water.

Subsequently, the substrates were immersed into an activating solution (an aqueous solution containing 100 ml/l of 98% sulfuric acid) at 40° C. for 3 minutes, and washed with water.

The substrates were then immersed into an electroless nickel plating solution (a "TMP Electroless Nickel HR-T" bath; product of Okuno Chemical Industries Co., Ltd.) at 40° C. for 6 minutes to form an electroless nickel plating film.

In Comparative Examples, the same substrates as used in Example 1 were etched using the etching compositions shown below in Table 2 in place of those used in Example 1. An electroless nickel film was then formed thereon in the same manner as in Example 1.

TABLE 1

| Name of Compound and Treatment | Examples | | | | | | | | | |
|---|---|---|---|---|---|---|---|---|---|---|
| Conditions | 1 | 2 | 3 | 4 | 5 | 6 | 7 | 8 | 9 | 10 |
| 98% sulfuric acid (g/l) | 50 | 50 | 50 | | | | 100 | 300 | 50 | 50 |
| 35% hydrochloric acid (g/l) | | | | 100 | 100 | 80 | | | | |
| Potassium permanganate (g/l) | 5.0 | 5.0 | 2.0 | 1.0 | 0.5 | 8.0 | 0.5 | 0.5 | 0.5 | 0.5 |
| Sodium perchlorate (g/l) | 30 | | | 50 | | | | | | |
| Sodium perbromate (g/l) | | 100 | | | 30 | | | | | |
| Sodium periodate (g/l) | | | 80 | | | 150 | 100 | 10 | | |
| Sodium persulfate (g/l) | | | | | | | | | 50 | |
| Sodium bismuthate (g/l) | | | | | | | | | | 50 |

TABLE 1-continued

| Name of Compound and Treatment | Examples | | | | | | | | | |
|---|---|---|---|---|---|---|---|---|---|---|
| Conditions | 1 | 2 | 3 | 4 | 5 | 6 | 7 | 8 | 9 | 10 |
| Temperature (° C.) | 65 | 65 | 65 | 65 | 65 | 65 | 50 | 65 | 65 | 65 |
| Time (min.) | 10 | 10 | 10 | 10 | 10 | 10 | 10 | 5 | 10 | 10 |

TABLE 2

| Name of Compound and Treatment | Comparative Examples | | | | | | | | |
|---|---|---|---|---|---|---|---|---|---|
| Conditions | 1 | 2 | 3 | 4 | 5 | 6 | 7 | 8 | 9 |
| 98% sulfuric acid (g/l) | 50 | 50 | 50 | | | | 200 | 50 | 50 |
| Potassium permanganate (g/l) | | | | 2.0 | 5.0 | 5.0 | 0.5 | | |
| Sodium perchlorate (g/l) | 100 | | | 30 | | | | | |
| Sodium perbromate (g/l) | | 20 | | | 100 | | | | |
| Sodium periodate (g/l) | | | 50 | | | 10 | | | |
| Sodium persulfate (g/l) | | | | | | | | 50 | |
| Sodium bismuthate (g/l) | | | | | | | | | 50 |
| Temperature (° C.) | 65 | 65 | 65 | 65 | 65 | 65 | 65 | 65 | 65 |
| Time (min.) | 10 | 10 | 10 | 10 | 10 | 10 | 10 | 10 | 10 |

The electroless nickel plating films formed by the above methods were evaluated for coverage, appearance, and adhesion. Table 3 below shows the test results.

(1) Coverage:

The area percentage of the substrate on which an electroless nickel plating film was formed was defined as coverage. Coverage was defined as 100%, when the entire surface of the test piece was covered with the plating film.

(2) Appearance:

The appearance of the plating film was evaluated with the naked eye.

(3) Adhesion Test:

After adhesive tape was applied to the surface of a plating film, the tape was peeled off in a direction vertical to the plating surface to check whether the plating film peeled off. Plating films received a "good" evaluation when no peeling of the plating film was observed with the naked eye. Plating films received a "poor" evaluation when peeling of the plating film was observed with the naked eye.

The electrolessly plated test pieces were subjected to electroplating using a copper sulfate plating bath at a current density of 3 A/dm$^2$ and a temperature of 25° C. for 120 minutes to form a copper plating film. The samples thus obtained were dried at 80° C. for 120 minutes, and allowed to stand to cool to room temperature. Thereafter, parallel cuts with a width of 10 mm were made in the plating film, and the plating film was pulled in a direction vertical to the resin surface using a tensile tester ("AUTOGRAPH SD-100-C"; product of Shimadzu Corp.) to determine the peel strength.

(4) Heat Cycle Test

After an electroless nickel plating film was formed on the substrates under the above-mentioned conditions, the electrolessly plated substrates were electroplated with a copper sulfate plating bath to a thickness of 10 to 15 μm, with a nickel plating bath to a thickness of 10 μn, and with a chrome plating bath to a thickness of 0.2 to 0.3 μm, to prepare test pieces. Three heat cycles, each cycle consisting of maintaining the test pieces at −30° C. for one hour, at room temperature for 30 minutes, and at +80° C. for one hour, were carried out. The test pieces were then checked for appearance and evaluated according to the following criteria.

A: No change observed; excellent appearance.

B: Slight dulling; no blistering and no cracking.

C: Cracking occurred.

D: Blistering of the plating occurred.

E: The electroplating film was formed incompletely.

TABLE 3

| | Coverage (%) | Appearance | Adhesion | Peel Strength (kgf/cm) | Heat Cycle Test |
|---|---|---|---|---|---|
| Example 1 | 100 | Good | Good | 1.0 | B |
| Example 2 | 100 | Good | Good | 1.1 | B |
| Example 3 | 100 | Good | Good | 1.1 | A |
| Example 4 | 100 | Good | Good | 1.0 | B |
| Example 5 | 100 | Good | Good | 1.0 | B |
| Example 6 | 100 | Good | Good | 1.1 | A |
| Example 7 | 100 | Good | Good | 1.2 | A |
| Example 8 | 100 | Good | Good | 1.1 | A |
| Example 9 | 100 | Good | Good | 1.0 | B |
| Example 10 | 100 | Good | Good | 1.1 | B |
| Comp. Ex. 1 | 50 | Poor | Poor | Unmeasurable | E |
| Comp. Ex. 2 | 50 | Poor | Poor | Unmeasurable | E |
| Comp. Ex. 3 | 60 | Poor | Poor | Unmeasurable | E |
| Comp. Ex. 4 | 50 | Poor | Poor | Unmeasurable | E |
| Comp. Ex. 5 | 60 | Poor | Poor | Unmeasurable | E |
| Comp. Ex. 6 | 70 | Poor | Poor | Unmeasurable | E |
| Comp. Ex. 7 | 80 | Poor | Poor | Unmeasurable | E |
| Comp. Ex. 8 | 50 | Poor | Poor | Unmeasurable | E |
| Comp. Ex. 9 | 50 | Poor | Poor | Unmeasurable | E |

The above results clearly show that when the surface of the test pieces is etched using the etching compositions of the invention containing an inorganic acid, a manganese salt, and at least one component selected from the group consisting of halogen oxoacids, halogen oxoacid salts, persulfate salts and bismuthate salts, and then electrolessly plated with nickel, electroless nickel plating films with good appearance are formed on the entire surface of the test pieces, and all of the obtained plating films have good adhesion with a peel strength of 1 kgf/cm or more.

In contrast, when etching is performed using the etching compositions of Comparative Examples 1 to 9, which do not contain at least one of the active ingredients of the etching composition of the invention, the obtained electroless nickel plating films have low coverage and poor adhesion.

The invention claimed is:

1. A composition for the etching treatment of a resin molded article, the composition comprising an aqueous solution containing:

20 to 1,200 g/l of an inorganic acid;

0.01 to 10 g/l of a manganese salt; and 1 to 200 g/l of at least one component selected from the group consisting of halogen oxoacids, halogen oxoacid salts, and bismuthate salts.

2. A composition for the etching treatment of a resin molded article, the composition comprising an aqueous solution containing:

20 to 1,200 g/l of at least one inorganic acid selected from the group consisting of sulfuric acid and hydrochloric acid;

0.01 to 10 g/l of at least one permanganate salt; and 1 to 200 g/l of at least one component selected from the group consisting of perchloric acid, perbromic acid, periodic acid, perchlorate salts, perbromate salts, periodate salts, persulfate salts, and bismuthate salts.

3. An etching process comprising bringing a resin molded article to be treated into contact with the composition of claim 1 or 2.

4. An electroless plating process comprising etching a resin molded article by the process of claim 3, then applying an electroless plating catalyst thereto, and subsequently performing electroless plating.

* * * * *

UNITED STATES PATENT AND TRADEMARK OFFICE

CERTIFICATE OF CORRECTION

PATENT NO. : 8,394,289 B2
APPLICATION NO. : 12/297371
DATED : March 12, 2013
INVENTOR(S) : Satou et al.

It is certified that error appears in the above-identified patent and that said Letters Patent is hereby corrected as shown below:

On the title page, Item (73):
Change

"(73) Assignee: Okuno Chemicals Industrial Co., Ltd.,
Osaka-shi (JP)"

to be

--(73) Assignee: Okuno Chemical Industrial Co., Ltd.,
Osaka-shi (JP)--

Signed and Sealed this
Twenty-third Day of July, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,394,289 B2
APPLICATION NO. : 12/297371
DATED : March 12, 2013
INVENTOR(S) : Satou et al.

It is certified that error appears in the above-identified patent and that said Letters Patent is hereby corrected as shown below:

On the title page, Item (73):
Change

"(73) Assignee: Okuno Chemicals Industries Co., Ltd.,
Osaka-shi (JP)"

to be

--(73) Assignee: Okuno Chemical Industries Co., Ltd.,
Osaka-shi (JP)--

This certificate supersedes the Certificate of Correction issued July 23, 2013.

Signed and Sealed this
Eighth Day of October, 2013

Teresa Stanek Rea
*Deputy Director of the United States Patent and Trademark Office*